US005079879A

United States Patent [19]

Rodriguez

[11] Patent Number: 5,079,879

[45] Date of Patent: * Jan. 14, 1992

[54] ANTI-CORROSIVE POST-TENSIONING ANCHORAGE SYSTEM

[76] Inventor: Alan Rodriguez, 2218 Crown Rd., Dallas, Tex. 75229

[ * ] Notice: The portion of the term of this patent subsequent to Apr. 18, 2006 has been disclaimed.

[21] Appl. No.: 573,498

[22] Filed: Aug. 27, 1990

Related U.S. Application Data

[63] Continuation-in-part of Ser. No. 336,254, Apr. 11, 1989, which is a continuation of Ser. No. 88,795, Aug. 24, 1987, Pat. No. 4,821,474.

[51] Int. Cl.[5] ..... E04C 3/10

[52] U.S. Cl. ..... 52/223 L; 24/122.6

[58] Field of Search ..... 52/223 R, 223 L, 230; 24/122.6

[56] References Cited

U.S. PATENT DOCUMENTS 3,289,379 12/1966 Watts .
3,524,228 7/1968 Kelly .
3,762,027 10/1973 Burtelson .
3,833,706 9/1974 Edwards .
4,121,325 10/1978 Bruinette et al. .
4,192,114 3/1980 Jungwirth et al. .
4,343,122 8/1982 Wlodkowski et al. .
4,363,462 12/1982 Wlodkowski et al. .
4,561,226 12/1985 Tourneur .
4,616,458 10/1986 Davis et al. .
4,621,943 11/1986 Swanson .
4,640,068 2/1987 Jungwirth et al. ..... 52/223 L
4,821,474 4/1989 Rodriguez ..... 52/223 L

OTHER PUBLICATIONS

Great Southwest Marketing Company Promotional Brochure for Aggressive Corrosion Protection (ACP).

*Primary Examiner*—Richard E. Chilcot, Jr.
*Attorney, Agent, or Firm*—Johnson & Gibbs

[57] ABSTRACT

A method of and apparatus for inhibiting the corrosion of a tendon within a post-tensioning anchor plate assembly. A tubular extension member protects the tendon and includes a foam injection port which is adapted for the injection of foam material to inhibit tendon corrosion, when it is sealed against the anchor plate. The tubular extension member further includes a circumferential ring disposed therearound providing a water stop to the infiltration of moisture after construction of the post-tensioning assembly. An anchor plate cap is also provided for covering the terminal end of the post-tensioned tendon. The cap is constructed with a radially extending ridge disposed along the inner edge for interlocking engagement with the anchor plate. A round die cut foam insert is provided in the cap to seal the terminal end of the tendon.

20 Claims, 2 Drawing Sheets

ANTI-CORROSIVE POST-TENSIONING ANCHORAGE SYSTEM

The present application is a continuation-in-part of U.S. patent application Ser. No. 336,254 filed on April 11, 1989, which is a continuation of U.S. patent application 07/088,798 filed Aug. 24, 1989, which is now U.S. Pat. No. 4,821,474 issued April 18, 1989, both of which are hereby incorporated by reference in their entirety.

BACKGROUND OF THE INVENTION

1. Field of the Invention

The present invention relates to post-tensioning concrete anchor assemblies and, more particularly, to an anti-corrosive anchor plate assembly adapted for both terminal end and intermediate anchor utilization.

2. History of the Prior Art

The prior art is replete with anchor plate assemblies adapted for the securement of post-tensioning tendons thereto for the tensioning of concrete structures. Engineering in the post-tensioning of concrete is a well developed technology and the utilization of such tendons extending through a concrete slab or beam is conventional. The tendons provide structural strength for the concrete in a manner and at a cost not heretofore possible with conventional rebar construction. Utilization of such tendons does, however, require anchor assemblies on opposite ends thereof. The anchor assemblies secure the ends of the tendons extending through the concrete bed and must remain effective during the lifespan of the construction. The effectiveness requires the protection of the tendons which are usually made of steel or the like, from corrosion. Corrosive forces are well known to cause deterioration in the strength of the concrete if allowed to jeopardize the integrity of the tensioning member. To prevent corrosion of the tendon, the steel fibers are usually sheathed in a plastic membrane throughout the length of the slab. The membranes do, however, require termination at the point where the tendons are secured within the anchor assemblies. The reason is obviously to provide appropriate structural integrity at the secured position.

In the process of post-tensioning, it is important that the tendon is free to move within the hardened concrete so that the tensile load on the tendon is evenly distributed along the entire length of the structure. Methods used to assure that the tendons provide free movement within hardened concrete include laying a number of strands of wire in a duct or tube. It is within this duct or tube that the strands of wire are stressed after the concrete is hardened. The duct or tube may be formed of metal or plastic and is usually filled with grease. The prior art also includes parallel strands of wire covered with grease and then covered with spirally wound paper. In some cases the wound paper is replaced by wound or wrapped plastic. Just the opposite is true of prestressing concrete cables. The cables are generally exposed to the concrete and are not covered with the sheath due to the fact that it is important that the concrete bond directly to the metal cable in its prestressed condition. Once the forms are set, the tension in the cable is also established so that once the concrete cures it forms a bond directly to the cable and no cable movement is allowed without movement on the concrete itself. There are, of course, advantages to both systems depending on the type of fabrication utilized in the ultimate application.

The present invention pertains to the anchor assemblies utilized in post tensioning configurations. Prestressing configurations do not require such anchor assemblies because the cables are cemented in the concrete and can simply be cut off. Post tensioning, however, incorporates the duct or plastic tube as described above and the utilization of anchors from opposite ends to produce the tensile force transmitted therethrough. Several prior art patents address such anchor assemblies for the post tensioning of a tendon in a concrete structural component. U.S. Pat. No. 4,363,462 issued to Wlodkowski et al. on Dec. 14, 1982 teaches one such anchor assembly. This particular structure also incorporates a recoverable part having an axially elongated sheath which closely encloses a tendon over a portion on the length of the sheath. When assembled in the formwork, one end of the sheath is arranged to be located within the concrete when it is poured and the other end is located on the exterior of the formwork. By removing the fastening means after the concrete has been poured, it is possible to remove the form and a cup member formed integrally with the sheath to form at least a portioned recess in the concrete member. Tensioning is then provided by conventional means with the tendons secured by wedges or the like in an orifice formed in the anchor plate. As set forth in this reference, it is an important consideration that the tendons be sufficiently protected against corrosion and this is affected by enclosing them in a plastic coating. It is likewise important to cover all areas of the tendon to provide protection against corrosion anywhere therealong. The most sensitive area of corrosion is in the vicinity of the locking wedges in the anchor plate and, therefore, that too is an area for which a sealant or covering must be applied. It may thus be seen that great care has been afforded the prior art structures by providing threaded and similar sealed engagement between the sheath coverings and the anchor assemblies.

There are numerous other approaches to post tensioning anchors for prestressed concrete as set forth and shown in the prior art. U.S. Pat. No. 4,121,325 to Bruinette et al. is a 1978 reference which teaches an anchor and coupling unit for use with stressing cables and reinforced concrete structures. In this particular embodiment the cable anchoring equipment addresses both pretensioned or post-tensioned, prestressed cementuous structures. As stated above, protective sheaths are located around the cables so that the latter may elongate under tension within the concrete. One end of the cable is anchored to the structure and this end is called the dead end. The other end of the cable called the "live end" includes a cable anchor on which the tensioning force may be applied. As discussed, it is necessary to protect both the dead and live anchoring ends of the cables because at these points the sheathing must be peeled back to enable the looking wedges or jaws of the tensioning mechanism to directly engage the cable. When the sheathing is stripped back it is necessary then to protect the cable because the strain induced upon the cable by the clamping jaws and/or wedges is the area in which corrosion will first manifest itself. Failure at this area means failure in the tensioning cable. Of primary consideration, however, is not simply the anchor assembly that is used on opposite ends of a concrete slab, beam or similar poured structure. It is well known to seal, grout or likewise cap the ends of the post-tensioning cables. Problems often arise when a series of contiguous slabs or structural members are poured seriatim with a continuous cable extending therethrough. Due to the length of the member, sections must be poured in discrete quantities and then individually post-tensioned. Once applied, the second contiguous section, must likewise be post-tensioned after pouring. This requires the utilization of an anchor or coupling assembly which allows both the post-tensioning of the first slab as well as the continuation of the tendon through the second slab or beam and the post-tensioning thereof. Such assemblies must also facilitate constructional mandates relative to the ease of use, cost and number of parts available for various jobs. A single anchor assembly which is adapted for both external and intermediate use and which is constructed for protecting the sheath cable for post-tensioning in the manner described above is a very necessary step.

Finally, U.S. Pat. No. 4,82,474 sets forth and describes several improvements in the post tensioning industry. Means are shown therein for fixedly securing the tendon and protecting it with a tubular extension member. The use of an anchor plate specifically constructed for such tubular members and protective caps was a marked advance in the industry. Several problems yet remain in the prior art. The position of the cap over the post tension anchor is often not secure. It would be an advantage to have a cap which could be easily secured to the anchor in the "capped" position. Another problem is the fact that in order to prevent corrosion, the cap is often filled with grease. This takes both time, labor and an excessive amount of grease, which is generally wasted. If a cap were not hollow, such a waste of grease would not occur. The hollow cap, however, is necessary to fit over the tendon extending from the anchor, which overcomes a problem existing in certain prior art designs. A similar problem exists for the tubes themselves. The tubes that cover the cable must also be filled with grease. Again, the grease is expensive and the pressure of the grease expanding into a large empty volume takes time, labor and can often result in misapplication. The securement of the cap and other members during the grease filling operation of the tube requires that the cap and tube be secured to the anchor plate. It is often a problem to maintain the assembly in prior art configurations. In particular, it is necessary that the cap and tube remain secured to the anchor plate and that the joints remain sealed in the anchored configuration after filling. Grease is utilized because it has inherent corrosion inhibitors, but this approach is fraught with problems.

The present invention provides an advance over the prior art by providing a post-tensioning anchor assembly that effectively inhibits corrosion of the post-tensioning anchorage system. The connector tube of the present invention is adapted for receiving expanding foam after engagement with the anchor body. This foam replaces the more expensive grease used in the prior art. Corrosion inhibitor is mixed with the foam as well as applied to the cable prior to injection of the foam. The invention further provides a method for injecting the foam into the connector tube such that it completely fills the void within the tube. The use of inert foam realizes benefits not seen with the grease used in the prior art in that the costs and waste are minimized. A water blocking ring appears on the exterior surface of the tube to minimize the travel of water from the anchor assembly to the small end of the tube. The small end of the connector tube includes a lip which meets with the sheathed cable to create a water tight seal further preventing the chance of introducing corrosive elements to the anchor assembly joint. While the prior art employs terminal end caps, the present invention utilizes an advanced snap-on cap means in conjunction with a segmented foam insert to insure a water tight seal. By incorporating these corrosion inhibitors, the present post-tensioning system advances the art by affording increased reliability, economy and lifespan.

SUMMARY OF THE INVENTION

The present invention pertains to a tendon anchoring system and method therefor. More particularly one aspect of the invention comprises an improved post tensioning anchor plate assembly of the type utilized for placement in concrete structures defined by pour forms. The anchor plate is capable of receiving a post-tensioning tendon therethrough and possesses a means for fixedly securing the tendon therein. The anchor plate assembly further includes at least one tubular extension member having a base region adapted for securement to the anchor plate such that the tubular member extends into the concrete structure thereby protecting the tendon adjacent that anchor plate. The improvement comprises an anchor plate cap adapted for receipt over, and the covering of, the terminal end of the post-tensioning tendon extending therefrom. The cap is constructed with a closed end and an open end, where the open end of the cap has a radially extending ridge disposed along the inner edge for interlocking engagement with the anchor plate. The cap further is adapted for receiving a round die cut foam insert which has a centrally disposed segmented portion therein. The diameter of the segmented portion is less than the diameter of the tendon and is adapted for compression in response to the insertion of the tendon into the cap, thus operating a press fit sealed interconnection. The tubular extension member possesses a foam injection port which is adapted for the injection of foam material. The foam material is sealed within the tubular member by a foam washer and a water tight lip seal thereby inhibiting corrosion of the tendon. The tubular extension member further includes a circumferential ring disposed therearound providing a water stop to the infiltration of moisture after the assembly thereof. The tubular extension member also includes a lip portion formed on the distal end thereof which is adapted for watertight engagement with the tendon for sealably confining the tendon within said tubular extension member.

In another aspect, the invention includes an improved anchor plate assembly of the type utilized for placement in a concrete structure defined by pour forms and the receipt of a post-tensioning tendon therethrough with means for fixedly securing the tendon therein. The anchor plate assembly further includes at least one tubular extension member having a base region adapted for securement to the anchor plate and extending into the concrete to protect the tendon therein. The improvement comprises an upstanding rib formed circumferentially about the tubular member intermediate of the opposite ends thereof. The rib is adapted for terminating water flow along the tubular member after its placement in concrete. The tubular member further includes at least one foam injection aperture formed therein adapted for receiving the infiltration of expanding foam therein. A foam washer adapted for receipt within the proximal end of the tubular member matingly engages the anchor plate preventing foam intrusion into the anchor plate. The anchor plate assembly also includes a cap member adapted for securely engaging the anchor plate on the opposite side thereof relative to the tubular extension member and adapted for receiving the tendon therein and the sealed termination thereof. A foam insert is disposed with the cap for sealably engaging the tendon.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Figure 1:
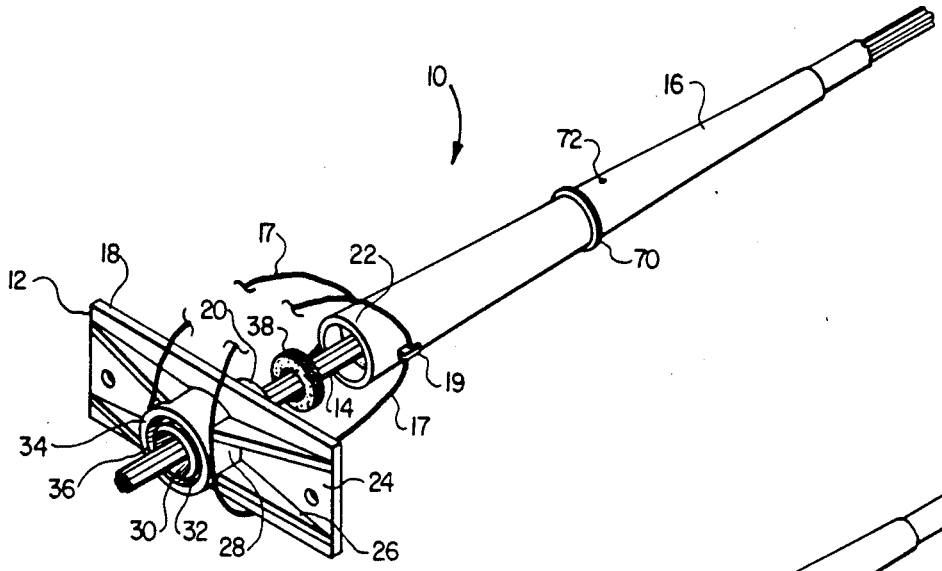
FIG. 1 is an exploded, perspective view of one embodiment of an anchor plate assembly constructed in accordance with the principles of the present invention.

Referring first to FIG. 1 there is shown an exploded perspective view of an anchor plate assembly constructed in accordance with the principles of the present invention. The anchor plate assembly 10 comprises a generally rectangular anchor plate 12 through which a sheathed post-tensioning tendon 14 extends. The tendon 14 of FIG. 1 is shown extending through the anchor plate 12 for purposes of illustration. The tendon 14 is further shown disposed within a series of removable, tapered, tubular members 16 which attaches to the rear face 18 of the plate 12. It is against the rear face 18 that the tensioning force applied to a concrete structure is generated by the post-tensioning cable 14. The tapered tubular member 16 is secured about a collar region 20 extending from the inside face 18 of the plate 12 in sealed engagement of the tendon 14 therein. Any number of tubular members 16 can be used by stacking them one upon another, in a "telescoping" type assembly. This also holds true for storage and shipping of tubular members 16, which are identical in size and shape and stackable one upon the other.

Referring still to FIG. 1, a cylindrical attenuating mating region 22 of enlarged diameter is provided at the proximal end of each tubular member 16 for engagement of the cylindrical collar 20 in slip fit frictional relationship. Appropriate sealing compounds and the like are used upon the cable 14 and around the collar 20 as is conventional in the prior art Of post-tensioning systems whereby the tendons 14 are sealed from the concrete and from other sources of corrosion. Located around the central region of tubular member 16 is water blocking ring 70 which radially extends about the outer circumference of tubular member 16. Just below water blocking ring 70 is foam injection port 72 which is adapted to receive the corrosion preventive foam 100, described below.

Still referring to FIG. 1 there is shown the front face 24 of the anchor plate 12. The front face 24 of the present embodiment is constructed with a series of gussets 26 tapering downwardly from a central cylindrical body section 28. The section can be formed without gussets 26 as needed for the particular application. The central body section 28 is constructed of somewhat larger size relative to the collar member 20 formed on the inside face 18 of the plate 12 but in axial alignment therewith. An aperture 30 is likewise formed centrally through the body portion 28, plate 12 and collar region 20 whereby tendon 14 may be received therein. The larger central body portion 28 is cylindrical in construction and comprises an inner wall 32 and an outer wall region 34. An annular region 36 is formed between said inner and Outer walls. Optional securing filaments 17, which may take the form of wires or plastic straps, secure the tubular member 16 to anchor plate 12. Connecting ears 19 formed on opposite sides of tubular member 16 receive the optional filaments 17 therearound. As described in more detail below this design affords numerous benefits including securement of tubular member 16 to plate 12 during pours, the interchangeability of components, cost savings and application flexibility in the anchor plate assembly 10 because said assembly can be utilized as an external anchoring unit or an intermediate anchor plate.

Referring still to FIG. 1, the anchor plate 12 may be adapted for use as a terminal anchor plate outwardly of a concrete structure or as an intermediate anchor plate due to the feasibility for receiving multiple tubular members on opposite sides thereof. The concrete structure is defined by pour forms 99 described in more detail below. The cylindrical mating region 22 of tubular member 16 is adapted to fit in press fit, frictional engagement with the respective mating surfaces of the plate 12. Mating region 22 is thus formed with an inside diameter slightly greater than the outside diameter of collar region 20 so that a press-slip fit interengagement is facilitated. A pre-formed foam washer 38 fits tightly around the tendon 14 and rests against collar region 20 and inside mating region 22 to prevent the injection of foam into the aperture 30.

Figure 2:
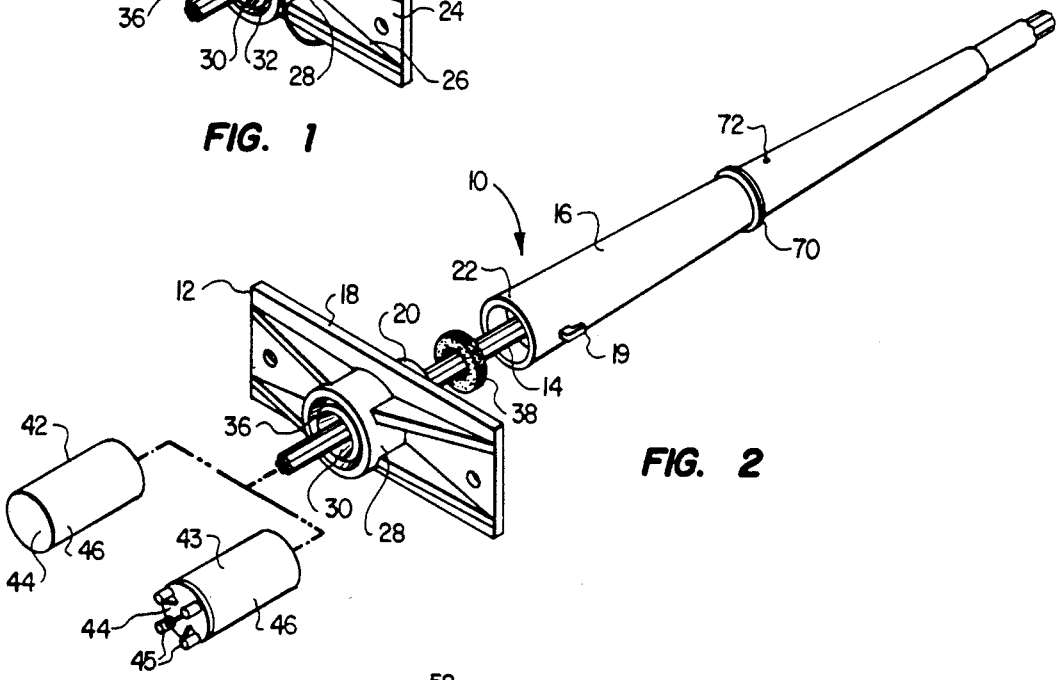
FIG. 2 is an exploded, perspective view of an alternative embodiment of the anchor plate assembly of FIG. 1 constructed in accordance with the principles of the present invention.

Referring now to FIG. 2 there is shown the anchor plate 12 of the present invention wherein tubular member 16 is again seen to cover tendon 14 therein. The plate 12 includes an inside surface 18 having a collar region 20 formed thereon and extending outwardly thereof. Likewise, central body region 28 is constructed as described above for receiving the tendon 14 therethrough. The embodiment shown in FIG. 2, illustrates use of the anchor plate assembly 10 as a terminal end with one of two cap members 42 and 43. The cap members 42 and 43 include a disk shaped ends 44 and cylindrical body regions 46. The cylindrical body region 46 has substantially the same diameter as the cup shape region 40 of tubular member 38. In this manner, the caps 42 and 43 are able to be received in the annular recess 36 for sealing the terminal end of a tendon 14 within the orifice 30. As described in more detail below cap 43 includes at least one and preferably a plurality of feet 45 for use in a "dead end" position. In this position the feet 45 are pressed against the inside of form 99 and the cap 43 pressed firmly against the anchor plate 12. This constitutes positive spacing of the anchor plate 12 from the form 99 and the ultimate face of the concrete 58. The length of the feet 45 may vary to accommodate specifications for concrete cover required in a given application. Further shown on cap members 42 and 43 is radially extending ridge 48 which engages annual region 36 to form a water tight seal. In these configurations, the anchor assembly 10 of FIG. 2 may be used at either the live or dead terminal end of a concrete structure wherein the tendon 14 is used for post tensioning said structure and terminated and secured at the anchor plate 12 as shown. Versatility and reliability are then provided in a most economical assembly.

Figure 3:
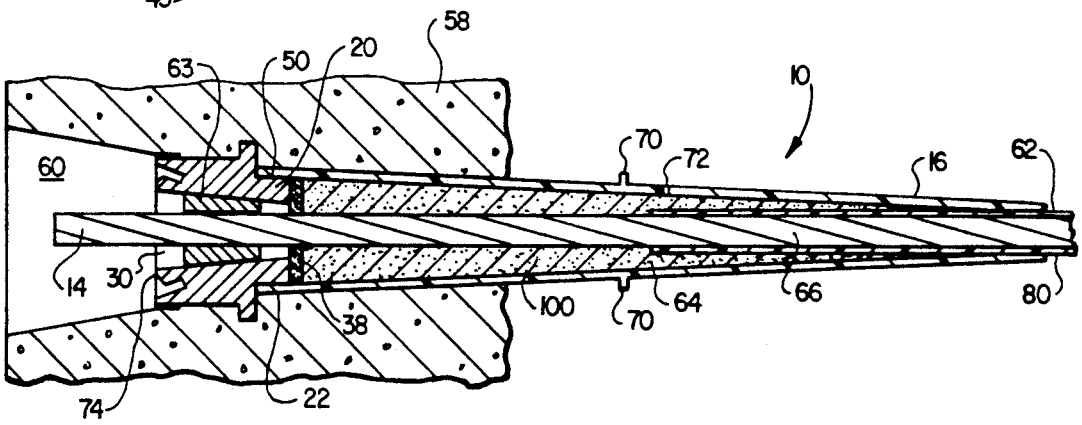
FIG. 3 is a side-elevational, cross-sectional view of the anchor plate assembly of FIG. 1 taken along line 3—3 thereof and illustrating the assembled configuration within a concrete structure.

Referring now to FIG. 3 there is shown a side-elevational, cross-sectional view of the assembled anchor plate 10 of FIG. 1. The tendon 14 is shown to have a sealing surface 50 between the inside wall of the mating region 22 and outside wall of the collar region 20 at the end of the tubular member 16. This particular embodiment of concrete structure 58 is shown poured around the tendon 14 and around tubular member 16 prior to a second pour around the front side 74. This would be the situation with the anchor plate 12 used in an intermediate anchor position. A cavity 60 is formed around the end of plate 12 by a "pocket former" (not shown), which cavity permits access to the plate 12 to attach a second tubular member or cap 42, 43 as the application mandates.

Still referring to FIG. 3, it may be seen that the tendon 14 itself is constructed with a protective sheath 62. Tubular member 16 and sheath 62 join in a press fit engagement thereby creating water tight seal 80. The sheath 62 is cut away in the portion of the tendon 14 that engages the anchor plate 12, as shown in FIGS. 1-4. This is to allow tensioning and/or placement of securement wedges 63 within the bore 30 of the anchor plate 12. The wedges 63 are tapered as is the bore of the anchor plate 12 for securing the tendon 14 against movement after post-tensioning. In the embodiment of FIG. 3 the sheath 62 is shown removed from the tendon 14 in the intermediate section as it passes through anchor plate 12. An annular bore 64 is thus formed around the raw cable strands 66. The raw strands 66 of tendon 14 are shown to be in direct engagement with the anchoring wedges 63 as is conventional in such constructions.

Still referring to FIG. 3 water blocking ring 70 is shown about the central region of tubular member 16. It can be seen that should water ingress down the sloping surface of tubular member 16, either by gravity or through a thermal expansion and contraction or peristalsis motion, the blocking ring 70 will prevent water diffusion to the exposed tendon 14. Below blocking ring 70 is foam injection port 72. By placing a small injector to the mouth of port 72 foam can be propelled toward both ends of tubular member 16. The foam 100 thereby fills the void between the tendon 14 and the inner wall of tubular member 16, thereby preventing the introduction of corrosive substances to the tendon 14. It is especially important to prevent such exposure as the raw strands 66 within the tubular member 16 lack a protective sheath 62. Pre-formed foam washer 38 can be seen resting against collar region 20 to prevent the introduction of foam into the aperture 30. It is necessary to block the foam 100 from entering the aperture 30 as the foam will inhibit the mechanical action of the securement wedges 63 against the raw strands 66.

Figure 4:
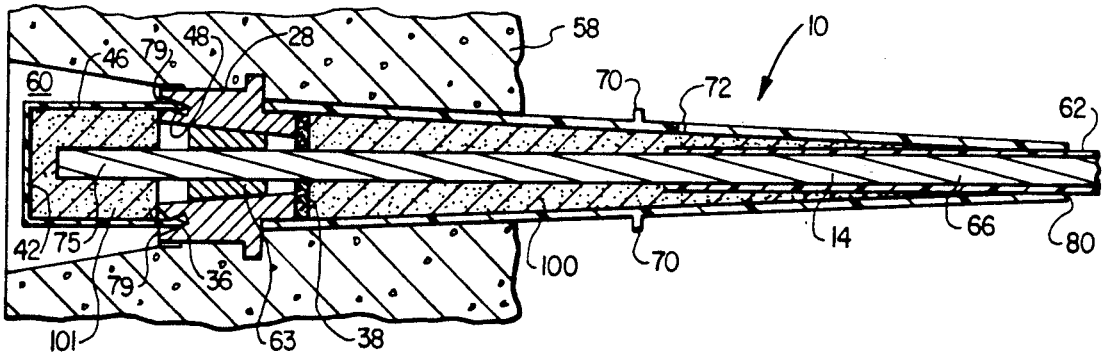
FIG. 4 is a side-elevational, cross-sectional view of the anchor plate assembly of FIG. 2 taken along lines 4—4 thereof and illustrating the assembled configuration within a concrete structure.

Referring now to FIG. 4 there is shown a side-elevational, cross-sectional view of the exploded anchor assembly 10 of FIG. 2 in an assembled configuration. As assembled, the tendon 14 is terminated at an end 75 within one of the caps 42 and 43. Cap 42 is used with a "live end" configuration where the tendon 14 is tensioned and then secured by wedges 63. A "dead end" is that tendon termination point where the tendon 14 is first secured with wedges 63, or the like, and sealed within the pour of concrete. It then forms the cable end against which tensioning occurs. The feet 45 (not shown) of dead end cap 44 are used to seat the cap 44 against the concrete pour forms shown by phantom lines 99 in FIGS. 3 and 4. The concrete pour forms 99 define the size and shape of the concrete structure 58. The feet 45 also provided "ears" to secure optional filaments 17 as shown in FIG. 1 which provides an assembly that will not come apart during the pour.

Referring still to FIG. 4, the body 46 of caps 42 and 43 is shown to be received within the annulus 36 of the central body region 28 to form a sealing surface 73 therein. FIG. 4 also illustrates an interlocking seal created by outwardly protruding circumferential lip 47 and radially extending ridge 48, both on the cap 42, with annulus 36. Joint sealant 79 may be applied to sealing surface 73 to further facilitate a water tight seal. Sealing surface 73 is created to prevent moisture and the corrosive material from attacking terminal end 75 of the tendon 14 which, as described above, is stripped back for exposing the raw strands 66 as shown herein. The sheath 62 is cut back into that region as shown in FIG. 4 and is very susceptible to corrosion in that area. Therefore, foam insert 101 is inserted into the cap prior to attachment as a protective cover for the raw strands 66. Because the wedges 63 provide the only means for securing the tendon 14 in the anchor plate 12 it is important that no corrosive forces are allowed to develop. In this particular embodiment various materials can be utilized to further seal the sealing surfaces in and around the cap and the cap itself can be sealed within the cavity 60 as it forms the terminal end of the post-tensioning cable 14 in accordance with the present invention.

Still referring to FIG. 4 foam 100 is injected within tubular member 16 through foam injection port 72. Pre-formed foam washer 38 prevents the injected foam 100 from disrupting the metal to metal engagement required between raw strands 66 and the wedges 63. Water tight sealing lip 80 also prevents the injected foam 100 from leaking out the small end of tubular member 16 wherein the tendon 14 enters the anchor assembly 10. The lip 80 may be formed of the same material as the member 16 and of a sufficiently thin wall construction to allow flexibility for sealing against the tendon 14. The flexibility of the sealing lip 80 permits the slidable entry of the tendon 14 and sheath 62, while at the same time forming a water tight seal about tendon 14. This aspect of the present invention, the flexibility and sealing capacity of water tight sealing lip 80, is not seen in the prior art. This element is necessary in that it permits the engineer in the field to easily assemble the post-tensioning device without concern of later corrosive contamination through the tendon/tube interface.

Figure 5:
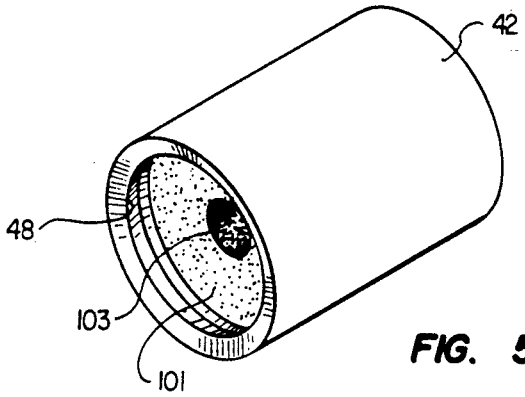
FIG. 5 is a perspective view of one embodiment of the cap of FIG. 2 illustrating the construction thereof.

Referring now to FIG. 5 there is shown a perspective view of the cap 42. Seen therein is foam insert 101 with segmented portion 103 adapted for receiving tendon end 75. The segmented portion 103 is preferably formed at the time the foam insert 101 is die out from a sheet of closed cell foam. The portion 103 is simply out and left within the body of the insert 101. When the tendon end 75 is received within cap 42, it compresses the segmented portion 103, the remaining insert 101 then tightly engaging said tendon. For this reason, the diameter of segment 103 is preferably less than the diameter of tendon 14 to achieve a press fit engagement therebetween. Radially extending ridge 48 is also shown inside the cap 42 encircling the inner wall circumference.

Figure 6:
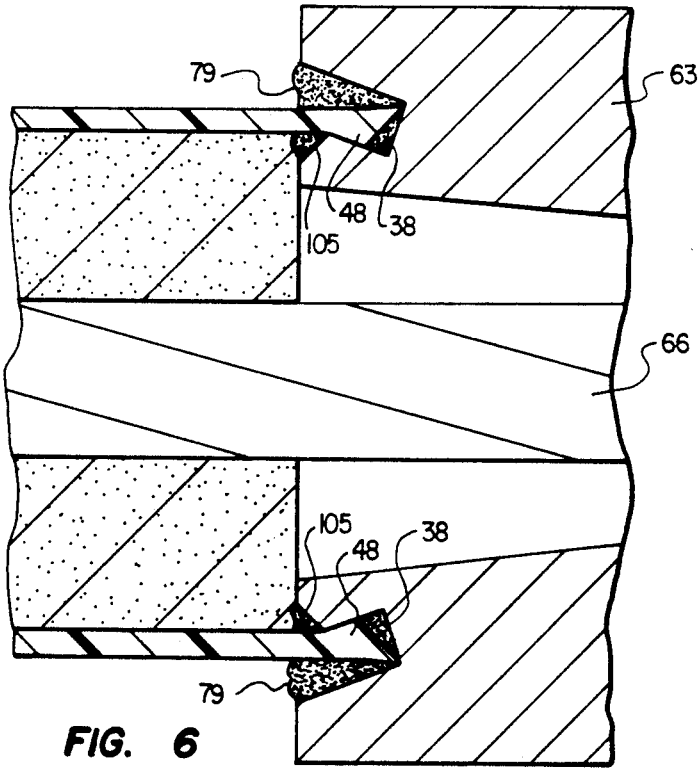
FIG. 6 is an enlarged side elevational, cross sectional view of the cap of FIG. 4 showing the engagement between the cap and the outer portion of the anchor plate.

FIG. 6 illustrates an enlarged view of the engagement between the cap 42 and the annulus 36 of central body region 28. Annulus 36 is shown with notches 105 which are adapted to receive radially extending ridge 48. It is seen by this engagement a water tight seal is created. To insure water tightness joint sealant may be applied to the annulus 36 prior to attachment of cap 42.

In operation, a post-tensioning cable 14 is placed within forms 99 where the anchor plates 12 are secured. The tubular member 16 and cap 43 are secured to the plate 12 by optional filaments 17 when needed. After conorete has been poured, tensioning is imparted against a "dead end" and the tendon 14 may then be cut and capped as shown in FIG. 4. It may, instead be placed in a position for a second pour as shown in FIG. 3 where a second tubular member may be utilized. In this manner a single anchor plate 12 can be utilized with two tubular members on opposite sides of anchor plate 12 or the tubular member 16 on one side and one of the caps 42 or 43 on the other to allow a wide range of flexibility in a construction technique which has found widespread acceptance in the construction industry. By utilizing press fit interengagement, the application of sealants is facilitated and the effectiveness of such sealants is greatly enhanced because the surfaces are dimensioned to maximize sealing and preventing corrosion. In the case of the dead end or live end discussed above, interlocking fit is allowed which greatly reduces the cost of both fabrication and use. The substitution of either a cap or a tubular member which is made water tight by the use of foam and corrosion inhibitor within the foam is clearly an advance over the prior art as is a tubular member that will friction fit either the front or rear of an anchor plate 12. When such a tubular member includes the sealing lip 80 and blocking ring 70, greatly improved reliability is afforded.

Still referencing the operation of the present invention, a myriad of applications are possible as set forth herein. The tapered tubular member 16 provides a means for facilitating handling and storage of said tubular members. Because of its fabrication from plastic or the like and the sizing for pressfit engagement with the anchor plate 12, both the ease and the reliability of the sealed surface therebetween is improved. As described above, the integrity of the sealed surface between the caps 42, 43 and tubular member 16 is of tantamount import. If the integrity of the sealed surface is broken, corrosion can set in. The utilization of this configuration greatly reduces the amount of grease necessary for maintaining the sealed configuration. The availability of a telescoping tubular section 16 also allows quick correction on the job if sheathing of a tensioning cable 14 has been stripped back too far. The application of a second tubular member 16 on top a first with the use of foam and a water tight seal 80 therebetween eliminates the need for replacement of the cable. This is a very significant attribute of the present invention from the standpoint of operation. Moreover, the utilization of the optional filament 17, which is preferably wire, maximizes the shipping, handling and pour efficiency of the post-tensioning anchor. With the tubular members or caps secured to the plate 12 by the optional filament 17, the problem of a dislodged part and a loose seal is advantageously eliminated.

Finally, it should be noted that it is possible to make the tubular member 16 as described herein from an injection molded process without the need to match threads for watertight closures as in many prior art configurations. The problem of holding tolerances normally found in threaded and/or cast elements conventional in the prior art is thus not present. The utilization of a press fit, frictional connection allowing the incorporation of both lubricant and sealant may thus be seen to provide a substantial advance over the prior art not heretofore possible.

It is thus believed that the operation and construction of the present invention will be apparent from the foregoing description. While the method and apparatus shown and described has been characterized as being preferred, it will be obvious that various changes and modifications may be made therein without departing from the spirit and scope of the invention as defined in the following claims.

What is claimed is:

1. An improved post tensioning anchor plate assembly of the type utilized for placement in a concrete structure defined by pour forms and the receipt of a post-tensioning tendon therethrough with means for fixedly securing said tendon therein and further including at least one tubular extension member having a base region adapted for securement to said anchor plate for extending into said concrete structure in protection of said tendon adjacent that anchor plate, wherein the improvement comprises:

an anchor plate cap adapted for receipt over, and the covering of, the terminal end of said post-tensioning tendon extending therefrom;

said cap being constructed with a closed end and an open end, said open end being adapted for engagement with said anchor plate;

a foam insert received within said cap and having a centrally disposed segmented portion therein;

said segmented portion of said insert having a diameter less than the diameter of said tendon and adapted for compression in response to the insertion of said tendon into said cap whereby said foam insert establishes a press fit sealed interconnection therewith during the securement of said cap to said anchor plate.

2. The apparatus as set forth in claim 1 wherein said cap is further constructed with a radially extending ridge disposed along said open end thereof, said ridge adapted for interlocking engagement with said anchor plate for the snap fit interconnection therewith.

3. The apparatus as set forth in claim 2 wherein said segmented insert is a round die cut section of said foam insert.

4. The apparatus as set forth in claim 1 wherein said tubular extension member is adapted for engagement with said anchor plate for outwardly projecting therefrom, said extension member further including a foam washer disposed therein, said foam washer having an aperture formed centrally therethrough adapted for receiving said tendon therein in sealed engagement therewith.

5. The apparatus as set forth in claim 4 wherein said tubular extension member further includes a foam injection port, said foam injection port being adapted for the injection of foam material, said foam being sealed within said tubular member by said foam washer and said watertight lip seal to thereby inhibit corrosion of said tendon.

6. The apparatus as set forth in claim wherein said tubular extension member further includes a circumferential ring disposed therearound for providing a water stop to the infiltration of moisture after the assembly thereof.

7. The apparatus as set forth in claim 5 wherein said tubular extension member further includes a lip portion formed on the distal end thereof, said lip portion adapted for watertight engagement with said tendon for sealably confining said tendon within said tubular extension member.

8. The apparatus as set forth in claim 2 wherein said cap further includes a round die cut foam insert having a central segmented portion adapted for compression upon the receipt of said terminal tendon therein during the mounting of said cap upon said anchor plate.

9. An improved anchor plate assembly of the type utilized for placement in a concrete structure defined by pour forms and the receipt of a post-tensioning tendon therethrough with means for fixedly securing said tendon therein and further including at least one tubular extension member having a base region adapted for securement to said anchor plate for extending into said concrete in protection of said tendon therein, wherein the improvement comprises an upstanding rib formed circumferentially about said tubular member intermediate of the opposite ends thereof, said rib adapted for terminating water flow along said tubular member after its placement in concrete for the protection of said tendon therein against corrosion thereof.

10. The apparatus as set forth in claim 9 wherein said upstanding rib is formed generally centrally between said opposite ends of said tubular member.

11. The apparatus as set forth in claim 9 wherein said tubular member further includes a foam washer adapted for receipt within a proximal end thereof, said proximal end being adapted for matingly engaging said anchor plate and said foam washer adapted for sealably engaging said anchor plate within said tubular member.

12. The apparatus as set forth in claim 11 wherein said tubular member is further formed with at least one foam injection aperture formed in sidewall thereof adapted for receiving the infiltration of expanding foam therein and throughout the interstitial area of said tubular member about said tendon between the opposite ends thereof and against said washer disposed therein.

13. The apparatus as set forth in claim 9 and further including a cap member adapted for locked engagement with said anchor plate on the opposite side thereof relative to said tubular extension member and adapted for receiving said tendon therein and the sealed termination thereof, said cap having a foam insert disposed therein for sealably engaging said tendon.

14. The apparatus as set forth in claim 13 wherein said foam insert further includes a generally centrally disposed segmented portion adapted for receiving said tendon therein.

15. The apparatus as set forth in claim 14 wherein said generally centrally disposed segmented portion has a diameter which is less than the diameter of said tendon for affording a press fit sealed engagement between said insert and said tendon.

16. The apparatus as set forth in claim 15 wherein said cap further includes means for securely mounting said cap to said anchor plate opposite said tubular extension member for maintaining sealed engagement of said tendon therebetween.

17. The apparatus as set forth in claim 16 wherein said means for securing said cap to said anchor plate includes an inner ridge formed on the mounting end of said cap for engaging said anchor plate in an interlocking engagement therewith.

18. The apparatus as set forth in claim 9 wherein said tubular extension member further includes a lip formed on a distal end thereof, said lip being adapted for receiving said tendon therein in sealed engagement therewith for providing a seal between said distal tapered end of said tubular member and said tendon received therein.

19. An improved method of post-tensioning concrete structures with post-tensioning tendons extending therethrough by the utilization of anchor plates and at least one tubular member disposed thereon, wherein the improvement comprises the steps of:

providing an anchor plate having first and second collar regions formed on opposites of a central aperture formed therethrough;

constructing said collar regions of said anchor plate for the press fit receipt of tubular members on both sides thereof;

providing an anchor plate cap with a tubular engagement portion adapted for mounting to a first collar region;

positioning said anchor plate adjacent a concrete structure area having tendons therein;

positioning one of said tubular members on a first of said tendons adjacent to said anchor plate;

extending said first tendon through said central aperture of said anchor plate;

sealably securing said tubular member to said anchor plate to define a sealed cavity within said tube and around said tendon extending outwardly therefrom;

post-tensioning said extending tendon through said anchor plate;

terminating said tendon outwardly of said anchor plate;

providing a foam insert within said cap, said insert adapted for the press fit receipt of said terminated tendon therein in sealed engagement therewith;

receiving said cap over said terminated tendon with said foam insert in sealed engagement therewith for inhibiting the corrosion of said terminated tendon therein; and injecting expanding foam into said tubular cavity for preventing the corrosion of the tendon therein.

* * * * *